US010669725B2

(12) United States Patent
Yang

(10) Patent No.: US 10,669,725 B2
(45) Date of Patent: Jun. 2, 2020

(54) DECK FIXING APPARATUS APPLIED TO URBAN PARKS AND ECOLOGICAL RIVERS

(71) Applicants: Sung Mo Yang, Bucheon-si (KR); YOOSHIN ENGINEERING CORPORATION, Seoul (KR)

(72) Inventor: Sung Mo Yang, Bucheon-si (KR)

(73) Assignees: Sung Mo Yang, Bucheon-Si, Gyeonggi-Do (KR); YOOSHIN ENGINEERING CORPORATION, Seoul (KR)

( * ) Notice: Subject to any disclaimer, the term of this patent is extended or adjusted under 35 U.S.C. 154(b) by 0 days.

(21) Appl. No.: 16/198,532

(22) Filed: Nov. 21, 2018

(65) Prior Publication Data

US 2019/0161976 A1 May 30, 2019

(30) Foreign Application Priority Data

Nov. 24, 2017 (KR) ..... 10-2017-0158663

(51) Int. Cl.
*E04F 13/08* (2006.01)
*E04F 15/02* (2006.01)
(Continued)

(52) U.S. Cl.
CPC ..... *E04F 15/02044* (2013.01); *E01C 5/001* (2013.01); *E01C 11/00* (2013.01);
(Continued)

(58) Field of Classification Search
CPC ..... E04F 15/02044; E04F 15/02183; E04F 15/02022; E01C 5/005; E01C 15/00
See application file for complete search history.

(56) References Cited

U.S. PATENT DOCUMENTS 2,880,481 A * 4/1959 Robinson, Jr. ..... E04F 13/085 52/512
5,502,942 A * 4/1996 Gras ..... B60R 13/0206 24/295
(Continued)

FOREIGN PATENT DOCUMENTS

JP 08-128125 A 5/1996
JP 4043299 B2 2/2008
(Continued)

*Primary Examiner* — Gisele D Ford
(74) *Attorney, Agent, or Firm* — Novick, Kim & Lee, PLLC; Jae Youn Kim

(57) ABSTRACT

Provided is a deck fixing apparatus including a rectangular support plate having a bottom surface which can partially come into contact with the top surface of a lower support; deck fixing parts formed by pressing the both side portions of the support plate and each of the deck fixing parts having a top surface for supporting the bottom surface of a deck and piece-fastened to the deck; and a support fixing part formed by extending a part of one side end of the support plate outwards in a plate surface direction so as to be fixed to the lower support, wherein the support plate has a cutout formed by cutting out a predetermined area inwards at the other side end of the support plate. Therefore, such deck fixing apparatuses can be coupled to each other in an angle-adjustable manner, thereby enabling the curve section construction of decks.

4 Claims, 6 Drawing Sheets

(51) Int. Cl.

| | |
|---|---|
| ***E01C 5/00*** | (2006.01) |
| ***E01C 11/00*** | (2006.01) |
| ***E04B 1/00*** | (2006.01) |
| *E01C 15/00* | (2006.01) |

(52) U.S. Cl.
CPC ..... *E04B 1/003* (2013.01); *E04F 15/02183* (2013.01); *E01C 5/005* (2013.01); *E01C 15/00* (2013.01); *E04F 2015/02072* (2013.01)

(56) References Cited

U.S. PATENT DOCUMENTS

| | | | | |
|---|---|---|---|---|
| 7,516,586 | B2 * | 4/2009 | Riccitelli | A47B 96/06 52/582.1 |
| 7,748,187 | B2 * | 7/2010 | Sensenig | E04B 5/12 52/480 |
| 9,290,889 | B2 * | 3/2016 | Choo | E01C 5/14 |
| 2005/0278934 | A1 | 12/2005 | Orchard | |
| 2010/0000179 | A1 * | 1/2010 | Norskov | E04B 5/12 52/745.21 |

FOREIGN PATENT DOCUMENTS

| | | | |
|---|---|---|---|
| KR | 10-1051069 | B1 | 7/2011 |
| KR | 10-2017-0025636 | A | 3/2017 |

* cited by examiner

DECK FIXING APPARATUS APPLIED TO URBAN PARKS AND ECOLOGICAL RIVERS

CROSS REFERENCE TO RELATED APPLICATION

The present application claims the benefit of Korean Patent Application No. 10-2017-0158663 filed in the Korean Intellectual Property Office on Nov. 24, 2017, the entire disclosure of which is incorporated herein by reference.

FIELD OF THE INVENTION

The present invention relates to a deck fixing apparatus, which is unexposed in the construction of decks on a walkway such as a mountain trail or a promenade.

BACKGROUND ART

In general, decks are installed on mountain trails, promenades, sidewalks, and terraces of houses, and are widely used as floor finishes because they are environmentally friendly and can absorb shock and vibration efficiently to create a quiet environment.

Korean Reg. Patent Publication No. 10-1051069 (hereinafter, referred to as patent document) discloses a deck fixing apparatus for fixing such decks on lower supports.

The deck fixing apparatus 100 of the patent document includes first protrusion surfaces 110, second protrusion surfaces 120, a plurality of fixing parts 130, a first extension part 140 and a plurality of insertion parts 141. When such deck fixing apparatuses 100 are coupled to each other, the plurality of fixing parts 130 cut and extended in the width direction so as to be in parallel to the first protrusion surfaces 110 are inserted into the lower portions of the insertion parts 141 provided to the first extension part 140 such that the deck fixing apparatuses 100 are connected to each other in serial.

According to this coupling structure, there is a problem that the angle between the deck fixing apparatuses 100 cannot be adjusted when at least one of the both side edges of decks are formed as a curve section, failing to carry out construction.

PRIOR ART DOCUMENTS

Patent Document

[Patent Document 0001] Korean Reg. Patent Publication No. 10-1051069, Title: Wooden deck fixing apparatus

SUMMARY OF THE INVENTION

Technical Problem

Accordingly, the present invention has been made to solve the above-mentioned problems occurring in the prior art, and it is an objective of the present invention to provide a deck fixing apparatus for enabling the construction of the curved sections of decks.

Technical Solution

To accomplish the above objective, a deck fixing apparatus according to one aspect of the present invention includes: a rectangular support plate having a bottom surface which can partially come into contact with the top surface of a lower support; deck fixing parts formed by pressing the both side portions of the support plate respectively and each of the deck fixing parts having a top surface for supporting the bottom surface of a deck and piece-fastened to the deck; and a support fixing part formed by extending a part of one side end of the support plate outwards in a plate surface direction so as to be fixed to the lower support, wherein the support plate has a cutout formed by cutting out a predetermined area inwards at the other side end of the support plate.

The support plate has an insertion protrusion provided in the lengthwise direction of the support plate and the insertion protrusion is protruded further by a predetermined length in the pressing direction of the deck fixing part so as to be inserted into a lengthwise groove of the deck.

The support plate has an inclination part provided at one end and inclined in the pressing direction of the deck fixing part.

The support fixing part has a press part provided to be pressed in a direction opposite to the pressing direction of the deck fixing part such that the bottom surface of the press part is seated on the top surface of the lower support so as to be coupled thereto.

The support plate has a line identification part, which is provided in the width direction of the support plate so as to be pressed in the same direction as the deck fixing part and has an angled hole formed in the center so as to enable to identify a display line indicating a construction position marked on the bottom surface of the deck.

Effect of the Invention

According to the deck fixing apparatus of the present invention as described above, such deck fixing apparatuses can be coupled to each other so as to be adjusted in angle therebetween, thereby enabling the construction of curve sections of decks.

BRIEF EXPLANATION OF REFERENCE SYMBOLS

| | |
|---|---|
| 10: | support plate |
| 10a: | cutout |
| 11: | insertion protrusion |
| 12: | inclination part |
| 13: | line identification part |
| 13a: | angled hole |
| 20: | deck fixing part |
| 30; | support fixing part |
| 31: | press part |
| D: | deck |
| G: | groove |
| I: | interval |
| L: | display line |
| S: | lower support |

DETAILED DESCRIPTION OF THE PREFERRED EMBODIMENT

Hereinafter, preferred embodiments of the present invention will be described in detail with reference to the accompanying drawings.

Prior to the description, the terms and wordings used in the specification and the claims should not be construed to be limited to general and lexical meanings and should be construed as meanings and concepts corresponding with the technical spirit of the present invention based on a principle that the inventor can suitably define the concepts of the terms to describe his or her invention in the best way.

Figure 1:
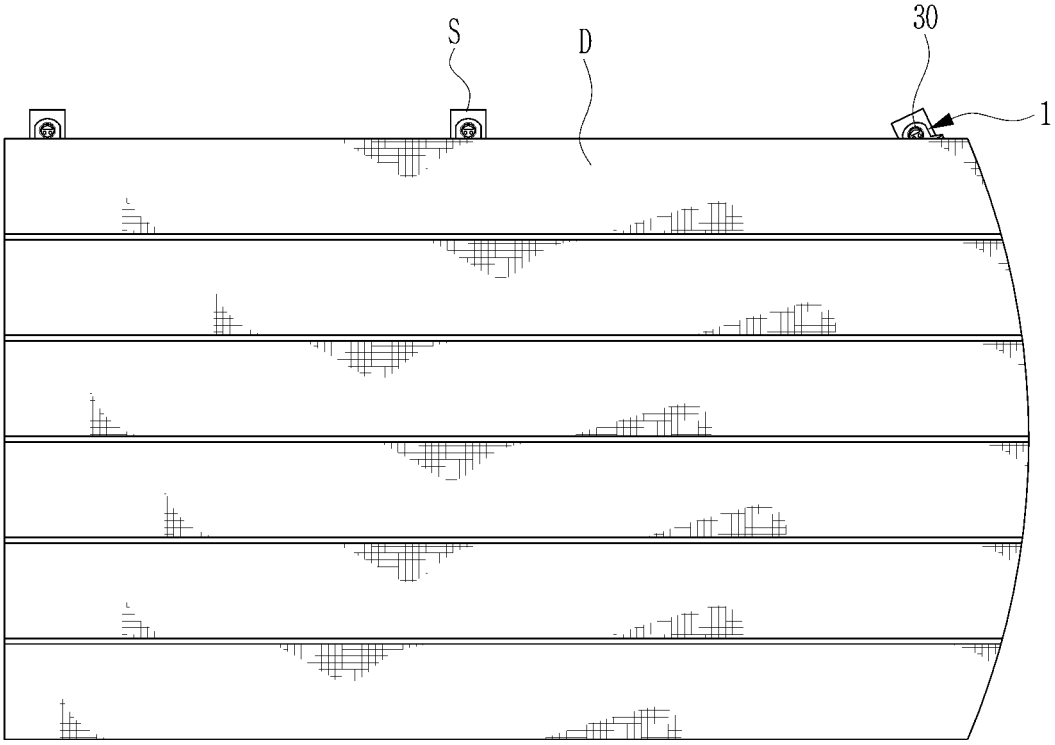
FIG. 1 is a plan view showing a construction state of deck fixing apparatuses according to an embodiment of the present invention.
Figure 2:
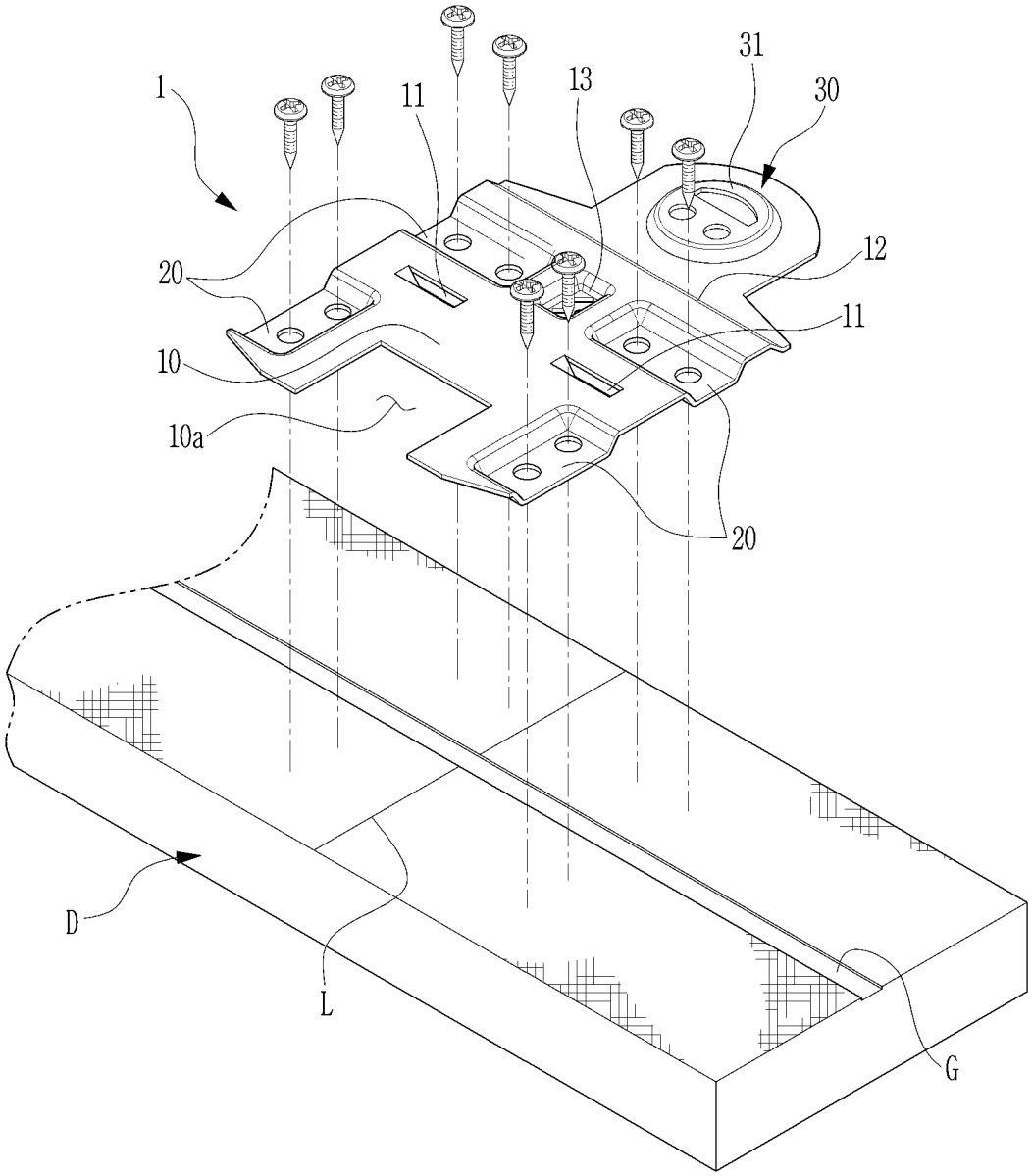
FIG. 2 is a perspective view showing a structure, in which a deck fixing apparatus is coupled to the rear surface of a deck of FIG. 1.
Figure 3:
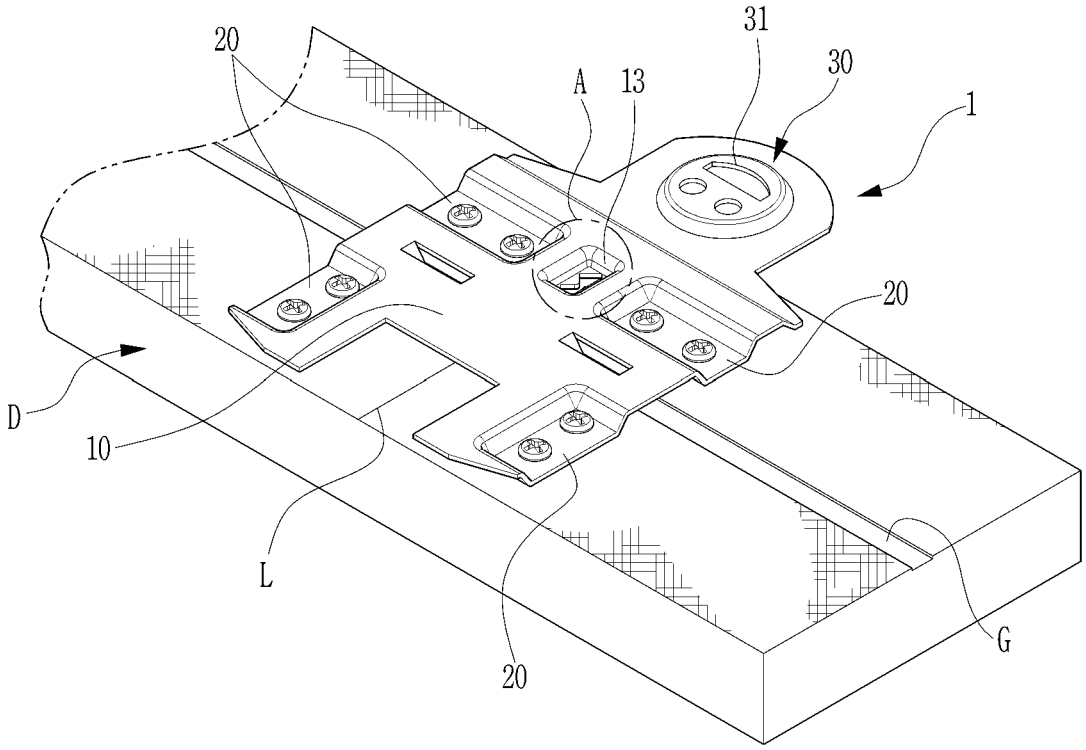
FIG. 3 is a view showing a coupling state of the deck fixing apparatus shown in FIG. 2.
Figure 4:
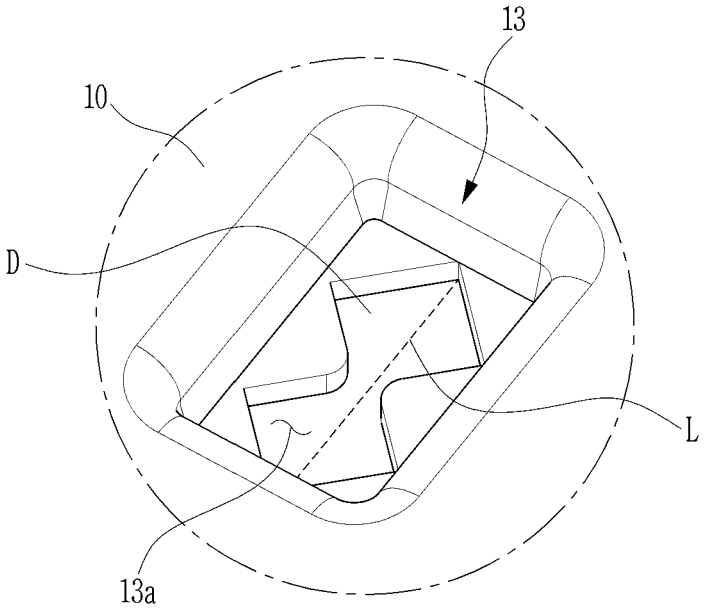
FIG. 4 is an enlarged view of part 'A' of FIG. 3.

FIG. 1 is a plan view showing a construction state of deck fixing apparatuses according to an embodiment of the present invention, FIG. 2 is a perspective view showing a structure, in which a deck fixing apparatus is coupled to the rear surface of a deck shown in FIG. 1, FIG. 3 is a view showing a coupling state of the deck fixing apparatus of FIG. 2, and FIG. 4 is an enlarged view of part 'A' of FIG. 3.

As show in FIG. 1 to FIG. 4, a deck fixing apparatus 1 according to an embodiment of the present invention includes a support plate 10, deck fixing parts 20, and a support fixing part 30.

The support plate 10 has a rectangular shape in which the bottom surface portion can partially come into contact with the top surface of a lower support S, and has a cutout 10*a* formed in the shape of a right side-opened square by cutting out a predetermined area inwards at the left side end of the support plate in FIG. 2. Herein, the shape of the cutout 10*a* is not limited to the illustrated right side-opened square shape, and may be variously modified, such as an ellipse and a circular shape.

The support plate 10 may further include an insertion protrusion 11 provided in the lengthwise direction of the support plate 10 and the insertion protrusion 11 is protruded further by a predetermined length in the pressing direction of the deck fixing part 20 so as to be inserted into a lengthwise groove G of a deck D. As shown in the drawings, it is possible to provide two insertion protrusions 11 to be arranged on the support plate 10 at a regular interval or a single insertion protrusion 11 formed to be long.

In addition, the support plate 10 has an inclination part 12 provided at one end of the support plate 10 and inclined in the pressing direction of the deck fixing part 20. This allows the support fixing part 30 to be located on a virtual horizontal line at a position slightly higher than the position of the support plate 10 and to be located on the same horizontal line as a press part 31 described later.

The support plate 10 may further include a line identification part 13, which is provided in the width direction of the support plate 10 so as to be pressed in the same direction as the deck fixing part 20 and has an angled hole 13*a* formed in the center so as to enable to identify a display line L indicating a construction position marked on the bottom surface of the deck D1, wherein the display line L may be a straight line or a curved line.

The deck fixing parts 20 are formed by pressing the both side portions of the support plate 10 and each of the deck fixing parts 20 has a top surface for supporting the bottom surface of the deck D and piece-fastened to the deck D. Even though two pairs of such deck fixing parts 20 are provided in the above embodiment of the present invention, it is also possible to form the deck fixing parts 20 long in the width direction and provide the same at both side edges of the support plate 10.

Meanwhile, the support fixing part 30 is formed by extending a part of the outer end of the support plate 10 outwards in a plate surface direction so as to be fixed to the lower support S. To this end, the support fixing part 30 has the press part 31 pressed in a direction opposite to the pressing direction of the deck fixing part 20 such that the bottom surface of the press part 31 is seated on the top surface of the lower support S so as to be coupled thereto, wherein a plurality of through holes (its reference sign is omitted) are provided in the press part 31 such that the press part 31 can be piece-coupled or welding-coupled depending on site conditions.

Hereinafter, the operation of the deck fixing apparatus of the present invention described above will be described with reference to the drawings.

Figure 5:
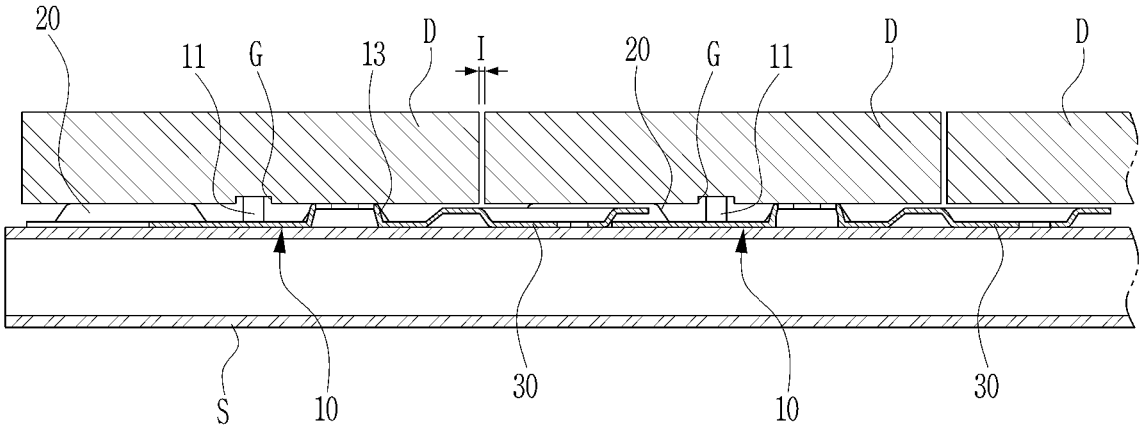
FIG. 5 is a cross-sectional view showing a construction state of FIG. 1.
Figure 6:
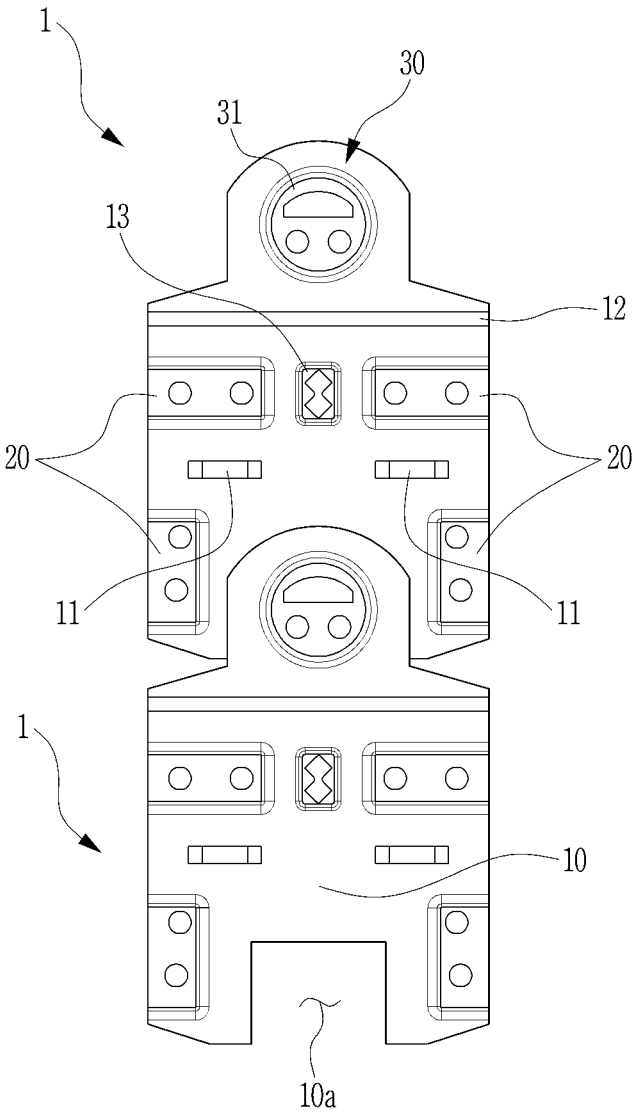
FIG. 6 is a view showing a preliminary coupling state, in which deck fixing apparatuses adjacent to each other in a straight section (the left side and the center portion) of FIG. 1 are connected to each other straight.
Figure 7:
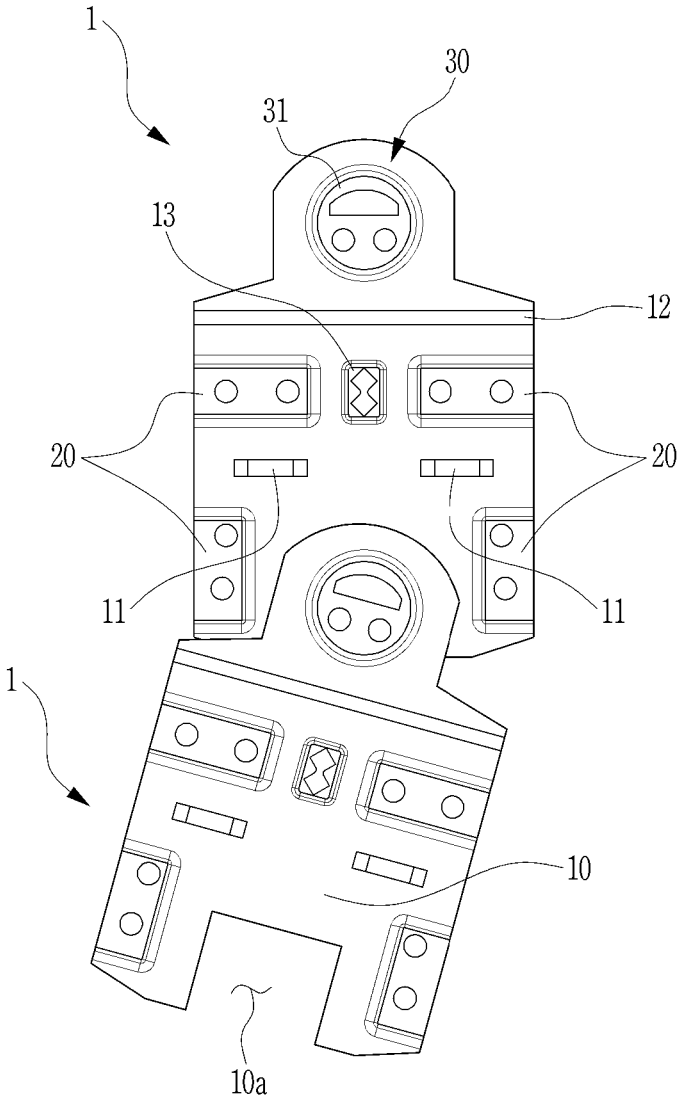
FIG. 7 is a view showing a preliminary coupling state, in which deck fixing apparatuses adjacent to each other in a curve section (the right side) of FIG. 1 are curvedly connected to each other.

FIG. 5 is a cross-sectional view showing a construction state of FIG. 1, FIG. 6 is a view showing a preliminary coupling state, in which deck fixing apparatuses adjacent to each other in a straight section (the left side and the center portion) of FIG. 1 are connected to each other straight, and FIG. 7 is a view showing a preliminary coupling state, in which deck fixing apparatuses adjacent to each other in a curve section (the right side) of FIG. 1 are curvedly connected to each other.

Referring to FIG. 5 showing a cross-section in parallel to the display line L, when one of the deck fixing apparatuses 1 is fastened to the bottom surface of the deck D at a portion corresponding to the straight section (the left side and the center portion) and then is seated on the lower support S, a part of the bottom surface of the support plate 10 comes into contact with the top surface of the lower support S.

Herein, the press part 31 of the support fixing part 30 is seated on the lower support S and the plurality of through holes provided in the press part 31 are exposed to a side surface of the deck D. Then, a worker fixes the deck fixing apparatus 1 to the lower support S by carrying out piece-coupling or welding-coupling with respect to the plurality of through holes as shown in FIG. 5.

Furthermore, the other one of the deck fixing apparatuses 1 is fastened on the bottom surface of another deck D and placed on the lower support S and then placed in the proximity of the deck D by slidingly moving this deck fixing apparatus 1 towards the side surface of the previously fixed deck D on the lower support S. Then, as shown in FIG. 6, the support fixing part 30 of one of the deck fixing apparatuses 1 is inserted between the support plate 10 of the other one of the deck fixing apparatuses 1 at the cutout side 10*a* thereof and the bottom surface of the deck D. Therefore, the further deck D is put in a locked state, and decks can be continuously coupled to each other by repeatedly carrying out the fastening work as described above.

In the curve section (the right side), one deck fixing apparatus 1 is mounted on the bottom surface of a deck D with an inclination according to a curved display line L and another deck fixing apparatus 1 is installed so as to overlap the previously mounted deck fixing apparatus 1 at a predetermined angle, as shown in FIG. 7.

Meanwhile, referring to FIG. 5, decks are installed at a predetermined interval I in consideration of the expansion and contraction of the timber by season. When replacing any one damaged deck D, the damaged deck D can be disassembled and replaced with a new one by inserting the blade portion of a grinder (not shown) through the interval I and cutting the support fixing part 30 of the deck fixing apparatus of the damaged deck D.

According to the deck fixing apparatus of the present invention as described above, the deck fixing apparatuses can be combined with each other in the angle-adjustable manner as above, thereby enabling the curve section construction of decks.

While the invention has been shown and described with reference to certain preferred embodiments thereof, it would be understood that the present invention is not limited to the forms described in the example embodiments and the technical and protective scope of the present invention shall be defined by the following claims. In addition, it should be also understood that all modifications, changes and equivalences within the technical scope of the present invention defined by the following claims belong to the technical scope of the present invention.

What is claimed is:

1. A deck fixing apparatus, comprising:

a support plate having a bottom surface which is configured to at least partially come into contact with a top surface of a lower support;

a plurality of deck fixing parts disposed on longitudinal edges of the support plate and protruded from a top surface of the support plate, each of the deck fixing parts having a top surface for supporting a bottom surface of a deck and fastened to the deck;

a support fixing part extending from a first lateral edge of the support plate, wherein the support fixing part has a press part protruded from a bottom surface of the support fixing part and having a circular shape such that a bottom surface of the press part is seated on the top surface of the lower support so as to be coupled thereto; and a cutout portion placed at a second lateral edge of the support plate, wherein a width of the cutout portion is same as or larger than a diameter of the press part.

2. The deck fixing apparatus according to claim 1, wherein the support plate has an insertion protrusion protruded from the top surface of the support plate and extended in a lengthwise direction by a predetermined length so as to be inserted into a lengthwise groove of the deck.

3. The deck fixing apparatus according to claim 1, wherein the support plate has an inclination part disposed at the first lateral edge of the support plate.

4. The deck fixing apparatus according to claim 1, wherein the support plate has a line identification part, which is disposed between the plurality of deck fixing parts and protruded from the top surface of the support plate, the line identification part having an angled hole formed in a center thereof.

* * * * *